US008522752B2

(12) United States Patent
Kim et al.

(10) Patent No.: US 8,522,752 B2
(45) Date of Patent: Sep. 3, 2013

(54) CO-AXIAL QUILL ASSEMBLY FOR DUAL FUEL COMMON RAIL SYSTEM

(75) Inventors: Hoisan Kim, Dunlap, IL (US); Mark F. Sommars, Hopewell, IL (US)

(73) Assignee: Caterpillar Inc., Peoria, IL (US)

( * ) Notice: Subject to any disclaimer, the term of this patent is extended or adjusted under 35 U.S.C. 154(b) by 554 days.

(21) Appl. No.: 12/875,384

(22) Filed: Sep. 3, 2010

(65) Prior Publication Data

US 2012/0055448 A1 Mar. 8, 2012

(51) Int. Cl.
*F02M 55/02* (2006.01)

(52) U.S. Cl.
USPC ..... 123/468; 123/469

(58) Field of Classification Search
USPC ..... 123/468, 469, 470, 525, 575; 285/121.1, 285/121.5, 123.1, 123.3, 123.14
See application file for complete search history.

(56) References Cited

U.S. PATENT DOCUMENTS

| | | | | |
|---|---|---|---|---|
| 3,612,577 | A * | 10/1971 | Pope et al. | 285/14 |
| 4,708,371 | A * | 11/1987 | Elsworth et al. | 285/13 |
| 5,239,964 | A * | 8/1993 | Diener et al. | 123/456 |
| 5,365,907 | A * | 11/1994 | Dietrich et al. | 123/470 |
| 6,227,173 | B1 * | 5/2001 | Bennett | 123/468 |
| 6,431,150 | B1 * | 8/2002 | Pearlman et al. | 123/468 |
| 6,588,406 | B2 | 7/2003 | Oprea | |
| 6,604,509 | B1 * | 8/2003 | Hegner | 123/456 |
| 6,827,065 | B2 * | 12/2004 | Goetzke et al. | 123/456 |
| 6,928,984 | B1 * | 8/2005 | Shamine et al. | 123/456 |
| 7,165,405 | B2 * | 1/2007 | Stuttaford et al. | 60/737 |
| 7,373,931 | B2 | 5/2008 | Lennox et al. | |
| 7,556,021 | B2 | 7/2009 | Toriumi et al. | |
| 7,591,253 | B2 | 9/2009 | Martindale | |
| 8,272,368 | B2 * | 9/2012 | Wickstone | 123/468 |
| 2005/0166899 | A1 | 8/2005 | Shamine et al. | |
| 2012/0234296 | A1 * | 9/2012 | Graspeuntner et al. | 123/469 |

FOREIGN PATENT DOCUMENTS

| | | |
|---|---|---|
| CA | 2635410 | 10/2008 |
| JP | 2003129913 | 8/2003 |
| WO | 2008019415 | 2/2008 |

* cited by examiner

*Primary Examiner* — Thomas Moulis
(74) *Attorney, Agent, or Firm* — Liell & McNeil

(57) ABSTRACT

A dual fuel common rail system includes first and second common rails fluidly connected to a fuel injector by a co-axial quill assembly. Distillate diesel fuel at a first pressure moves from the first common rail through a first fuel passage defined by a quill, through an inner tube and into the fuel injector. Liquid natural gas a second lower pressure moves from the second common rail through a second fuel passage defined by the quill, through a space between the outer tube and the inner tube, and finally into the fuel injector. The quill is partially positioned in a block. First and second compression load adjusters are threadably attached to the block to adjust a compression load on the inner tube and outer tube to inhibit leakage of fuel from the tubes.

20 Claims, 2 Drawing Sheets

CO-AXIAL QUILL ASSEMBLY FOR DUAL FUEL COMMON RAIL SYSTEM

TECHNICAL FIELD

The present disclosure relates generally to dual fuel common rail systems, and more particularly to a co-axial quill assembly for fluidly connecting first and second common rails to a fuel injector.

BACKGROUND

Common rail fuel systems are well known in the art of compression ignition engines. A typical common rail fuel system includes a common fuel rail that supplies fuel injectors for an engine via individual quill tubes. Because of the high pressures involved, some jurisdictions require a double wall containment strategy for capturing leaked fuel. For instance, co-owned U.S. Patent application 2005/0166899 teaches a high pressure line connection strategy for fluidly connecting a common rail to fuel injectors. Common rail fuel systems can be found that utilize either distillate diesel fuel or heavy fuel oil as the fuel medium. Increasingly, industry has turned toward common rail fuel systems as one strategy for improving burn characteristics to reduce the production of undesirable emissions, including NOx, unburnt hydrocarbons and the like in order to relax demands on aftertreatment systems.

Gaseous fuel engines are known for their ability to burn relatively clean relative to their compression ignition engine counterparts. However, gaseous fuels are well known for the difficulty in attaining successful ignition. Some gaseous fuel engines utilize a spark plug, whereas other engines are known for utilizing a small amount of distillate diesel fuel that is compression ignited to in turn ignite a larger charge of gaseous fuel. Practical spatial limitations in and around an engine often make it difficult to find space for all of the plumbing and hardware associated with supplying two different fuels to each combustion chamber. In this regard, Canadian patent 2,635,410 is of interest for teaching a dual fuel connector that relies upon a single quill that includes two different internal passages to facilitate fluid connection to two different fuel inlets of a fuel injector. However, this reference fails to teach a practical strategy for inhibiting fuel leakage between the two different fuels and from either fuel supply to atmosphere where the illustrated tube contacts the fuel injector.

The present disclosure is directed toward one or more of the problems set forth above.

SUMMARY OF THE DISCLOSURE

In one aspect, a co-axial quill assembly for a dual fuel common rail fuel system includes a quill at least partially positioned in a block. The quill defines a first fuel passage extending between a first fuel inlet and a first fuel outlet, and a second fuel passage extending between a second fuel inlet and a second fuel outlet. An outer tube has one end extending into the block and is fluidly connected to the second fuel outlet of the quill. An inner tube is positioned inside the outer tube and is fluidly connected to the first fuel outlet of the quill. A first compression load adjuster is attached to the block and operably coupled to adjust a compression load on the inner tube. A second compression load adjuster is attached to the block and operably coupled to adjust a compression load on the outer tube.

In another aspect, a method of supplying fuels to a fuel injector with a co-axial quill assembly includes moving a first fuel at a first pressure from a first common rail through a first fuel passage of a quill, through an inner tube and into a fuel injector. A second fuel is moved at a second pressure from a second common rail through a second fuel passage of the quill, through a space between the outer tube and the inner tube, and finally into the fuel injector. Leakage of the second fuel into the first fuel is inhibited by setting the first pressure higher than the second pressure. Leakage of the first fuel into the second fuel is inhibited by setting a compression load on the inner tube above a first predetermined threshold with the first compression load adjuster. Leakage of the second fuel to atmosphere is inhibited by setting a compression load on the outer tube above a second predetermined threshold with the second compression load adjuster.

In still another aspect, a dual fuel common rail fuel system includes a quill that defines first and second fuel passages therethrough. A fuel injector defines a first conical seat concentrically surrounding a second conical seat, and includes a first fuel inlet surrounded by the first conical seat, and a second fuel inlet positioned between the first conical seat and the second conical seat. An outer tube is compressed between the quill and the fuel injector, and fluidly connects a second fuel outlet of the quill to the second fuel inlet of the fuel injector. An inner tube is positioned in the outer tube and is compressed between the quill and the fuel injector, and fluidly connects a first fuel outlet of the quill to the first fuel inlet of the fuel injector. A first compression load adjuster is operable to adjust a load of the inner tube on the first conical seat, a second compression load adjuster is operably coupled to adjust a load of the outer tube on the second conical seat.

DETAILED DESCRIPTION

Figure 1:
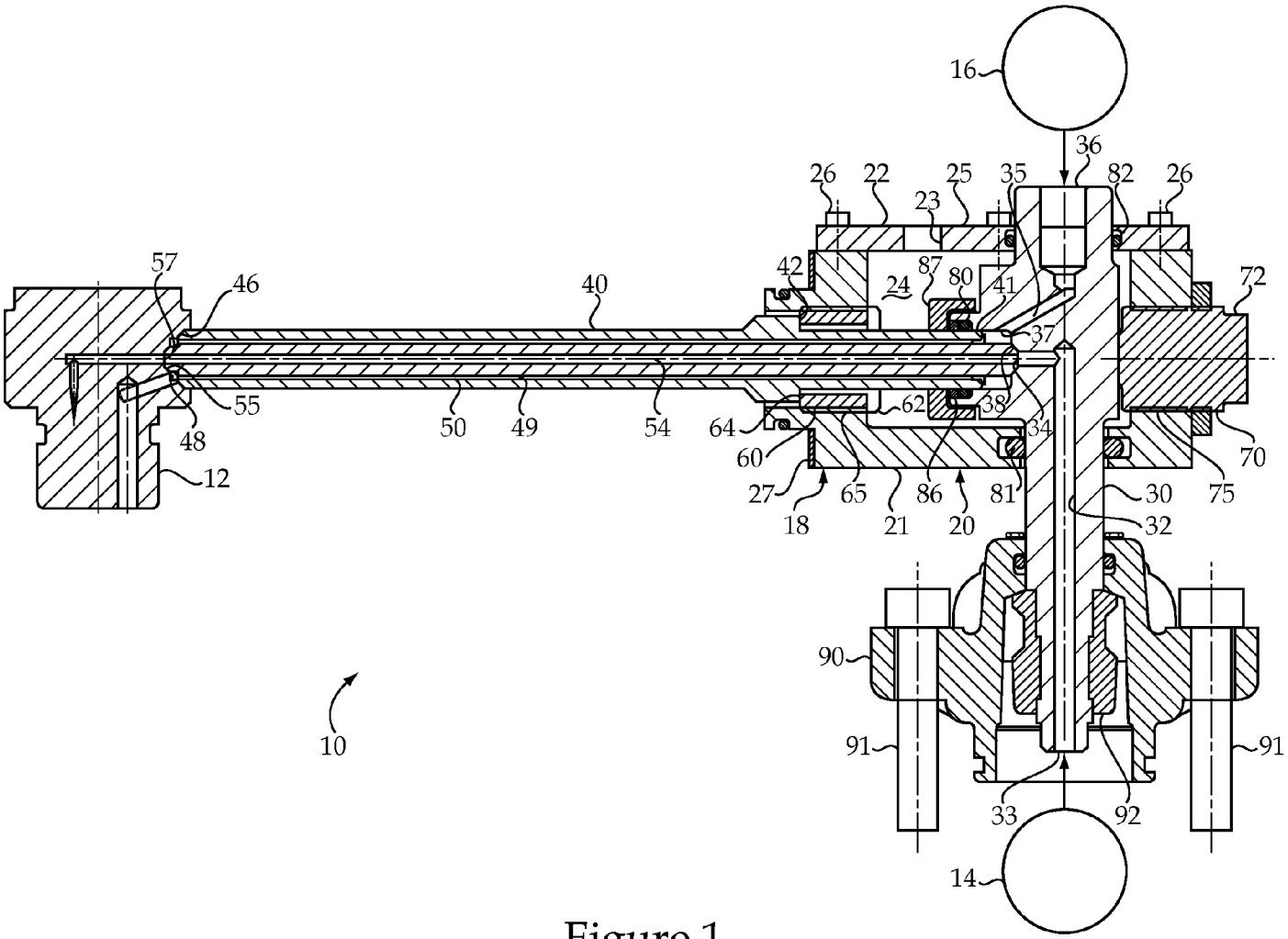
FIG. 1 is a sectioned side view of a dual fuel common rail system according to the present disclosure.
Figure 2:
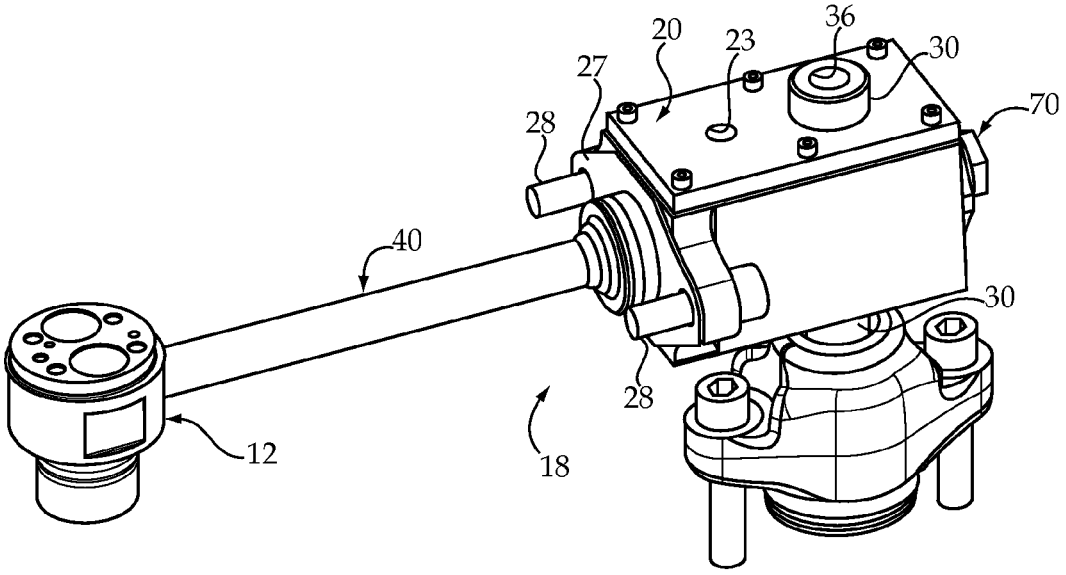
FIG. 2 is a pictorial isometric view of the co-axial quill assembly shown in FIG. 1.

Referring to FIGS. 1 and 2, a dual fuel common rail system 10 includes a coaxial quill assembly 18 fluidly connecting a fuel injector 12 with first and second common rails 14, 16, respectively. Although the concepts of the present disclosure could apply to a variety of fuels for different types of engines, the illustrated embodiment is particularly suited for a gaseous fuel engine that utilizes distillate diesel fuel for compression ignition. In other words, an engine associated with dual fuel common rail system 10 might primarily burn liquefied natural gas supplied form second common rail 16, and ignite that charge in the engine combustion space by compressor igniting a smaller charge of distillate diesel fuel from common rail 14 during a combustion event.

Coaxial quill assembly 18 includes a quill 30 at least partially positioned in a block 20. The quill includes a first fuel passage 32 extending between a first fuel inlet 33, which is fluidly connected to first common rail 14, and a first fuel outlet 34. Quill 30 also defines a second fuel passage 35 extending between a second fuel inlet 36, which is fluidly connected to second common rail 16, and a second fuel outlet 37. Quill 30 is fluidly connected to rails 14 and 16 using known hardware (e.g., fittings) and techniques. Fuel from first common rail 14 is moved through an engine head (not shown) via inner tube 50, while fuel from second common rail 16 is moved to fuel injector 12 in the space 49 between inner tube 50 and an outer tube 40. Inner tube 50 may be of a familiar construction to those skilled in the art, in that it includes rounded or conical ends that are compressed between a conical seat 38 of quill 30 and an inner conical seat 55 of fuel injector 12. Thus, the fluid passage within inner tube 50 extends between first fuel outlet 34 of quill 30 and an inner fuel inlet 57 of fuel injector 12. Second tube 40 has an inner diameter larger than an outer diameter of inner tube 50 in order to define an elongate annular space 49 that opens on one end to second fuel outlet 37 of quill 30 and at its other end to an outer fuel inlet 48 of fuel injector 12. Outer tube 40 includes a rounded or conical end that is compressed into sealing contact with outer conical seat 46 of fuel injector 12. The outer fuel inlet 48 opens between the inner diameter of tube 40 and the outer surface of inner tube 50. Thus, fuel injector 12 defines an outer conical seat 46 that concentrically surrounds an inner conical seat 55. In addition, the fuel injector 12 includes an inner fuel inlet 57 surrounded by the inner conical seat 55, and an outer fuel inlet 48 positioned between the inner conical seat 57 and the outer conical seat 46.

Outer tube 40 is compressed between quill 30 and the fuel injector 12. In particular, outer tube 40 includes a rounded or conical end in sealing contact with outer conical seat 46 and an opposite end received in a bore defined by quill 30. One end 41 outer tube 40 is sealed via an O-ring 80 that is positioned in a space 45 between outer tube 40 and quill 30. O-ring 80 is maintained in place against the pressure from second common rail 16 by a back up ring 86 held in place by a cap 87 threaded to quill 30. Outer tube 40 is compressed onto outer seat 46 of fuel injector 12 by an axial force applied to a load shoulder 42 by a compression load adjuster 60 that includes a contact surface 64 in contact with load shoulder 42. Compression load adjuster 60 includes outer threads 65 that mate with a set of inner threads defined by base 21 of block 20, and includes a tool engagement surface 62 located in hollow interior 24 of block 20 to facilitate adjusting a compression load on outer tube 40. Thus, leakage of the second fuel from common rail 16 to atmosphere is inhibited by setting a compression load on the outer tube 40 with compression load adjuster 60 above a predetermined threshold to facilitate a seal at outer conical seat 46.

Sealing at opposite ends of inner tube 50 is facilitated by a separate load adjuster 70 that includes threads 75 mated to internal threads defined by base 21 of block 20. Load adjuster 70 includes a tool engagement surface 72 located outside of block 20 that facilitates movement of compression load adjuster 70 along a common centerline 54. In other words, compression load adjuster 70 pushes along common centerline 54 against quill 30 to compress inner tube 50 between conical seat 38 of quill 30 and conical seat 55 of fuel injector 12. Because one end 41 of outer tube 40 can slide within quill 30, the respective compression loads on inner tube 50 and outer tube 40 can be adjusted independently to better insure proper sealing at all of the conical seats 38, 55 and 46. Thus, leakage of the first fuel originating from common rail 14 into the second fuel is inhibited by setting a compression load on the inner tube 50 above a predetermined threshold with compression load adjuster 70. In addition, leakage of the second fuel from common rail 16 into the first fuel from common rail 14 may include setting the pressure in common rail 14 higher than the pressure in common rail 16. Outer tube 40, inner tube 50, compression load adjuster 60, compression load adjuster 70, conical seat 38, inner conical seat 55 and outer conical seat 46 all share a common centerline 54.

As shown, quill 30 may be at least partially positioned within block 20, which includes a base 21 and a cover 22 that may be attached to base 21 by a plurality of fasteners 26. Base 21 may include a flange (FIG. 2) that facilitates attachment of block 20 to an engine head via bolts 28. As shown in the Figures, the first fuel inlet 33 and the second fuel inlet 36 of quill 30 may be located outside of block 20. A shim 27 may be included to adjust the distance between conical seat 38 and conical seat 57 to compensate for geometrical tolerances in the fuel system and engine components. Any of the second fuel that manages to leak past O-ring 80 into hollow interior 24 of block 20, may be vented to atmosphere via vent opening 23. Thus, vent opening 23 might be eliminated in a case where the fuel in common rail 16 is not gaseous at atmospheric pressure. Except for vent opening 23, hollow interior 24 may be substantially closed via an O-ring 81 that is in contact with quill 30 and block 20 and surrounds first fuel passage 32. In addition, a second O-ring 82 may be in contact with quill 30 and block 20 and surround the second fuel passage 35. Thus, vent opening 23 extends between hollow interior 25 and an outer surface 25 of block 20, which is exposed to atmosphere.

Coaxial quill assembly 18 may also include a flange 90, collar 92 and bolts 91 to facilitate a sealed fluid connection between quill 30 and common rail 14. Although co-axial quill assembly 18 is illustrated as including a separate block 20 and quill 30, those skilled in the art will appreciate that the functions and structures of those two components could be merged into a single component without departing from the present disclosure.

Industrial Applicability

The dual fuel common rail system 10 of the present disclosure finds general applicability to any engine that utilizes two fuels in the combustion space of an associated engine. These two fuels may be the same fuel at two different pressures, or may, as in the illustrated embodiment be different fuels. Although the present disclosure could apply to spark ignited engines utilizing appropriate fuels, the present disclosure finds particular applicability in gaseous fuel engines that utilize a relatively large charge of natural gas that is ignited via compression ignition of a small charge of distillate diesel fuel originating from common rail 14. The coaxial quill assembly 18 of the present disclosure can facilitate movement of both fuels to a fuel injector 12 mounted in the head of an engine via a single bore through the engine head associated with each fuel injector of the engine. This strategy conserves valuable space in and around the engine.

By utilizing a block 20 that is bolted to the outer surface of the engine head, separate load adjusters 60 and 70 can be utilized to independently load the inner tube 50 and outer tube 40 onto the conical seats 57 and 46, respectively of fuel injector 12 to inhibit fuel leakage between the fuels and to inhibit fuel leakage outside of fuel injector 12. In the event that system 10 was being utilized with two liquid fuels, an additional outer wall containment strategy (not shown) could be added to comply with double walled pressure containment regulations associated with certain jurisdictions.

When in operation, the first fuel at a first pressure moves from first common rail 14 through the first fuel passage 32, through inner tube 50 and into fuel injector 12. The second fuel at a second pressure is moved from the second common rail 16 through the second fuel passage 35, through the space 49 between outer tube 40 and inner tube 50 and into fuel injector 12. Leakage of the second fuel to the first fuel may be inhibited by setting the pressure in common rail 14 (maybe about 40 MPa) higher than the pressure in common rail 16 (maybe about 35 MPa). Leakage of the first fuel into the second fuel includes setting a compression load on the inner tube 50 above a first predetermined threshold with the compression load adjuster 70 to create appropriate sealing forces on both ends of quill 50. Leakage of the second fuel to atmosphere includes setting a compression load on the outer tube 40 above a second predetermined threshold with the second load adjuster 60 to create a seal between outer tube 40 and fuel injector 12.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A coaxial quill assembly for a dual fuel common rail fuel system comprising:

a block;

a quill at least partially positioned in the block and defining a first fuel passage extending between a first fuel inlet and a first fuel outlet, and a second fuel passage extending between a second fuel inlet and a second fuel outlet;

an outer tube with one end extending into the block, and being fluidly connected the second fuel outlet of the quill;

an inner tube positioned in the outer tube, and being fluidly connected the first fuel outlet of the quill;

a first compression load adjuster attached to the block and operably coupled to adjust a compression load on the inner tube; and a second compression load adjuster attached to the block and operably coupled to adjust a compression load on the outer tube.

2. The coaxial quill assembly of claim 1 wherein the outer tube includes a load shoulder in contact with the second compression load adjuster; and the first compression load adjuster being in contact with the quill.

3. The conical quill assembly of claim 1 wherein the outer tube, the inner tube, the first compression load adjuster and the second compression load adjuster all share a common centerline.

4. The coaxial quill assembly of claim 1 wherein the block includes a cover attached to a base; and one of the base and the cover define a vent opening extending between an interior cavity of the block and an outer surface of the block.

5. The coaxial quill assembly of claim 1 wherein the second compression load adjuster includes a tool engagement surface located inside the block; and the first compression load adjuster includes a tool engagement surface located outside the block.

6. The coaxial quill assembly of claim 1 wherein the inner tube is in contact with a conical seat of the quill; and an O-ring in sealing contact with the outer tube and the quill.

7. The coaxial quill assembly of claim 1 wherein the first fuel inlet and the second fuel inlet of the quill are located outside the block;

a first O-ring in contact with the quill and the block and surrounding the first fuel passage; and a second O-ring in contact with the quill and the block and surrounding the second fuel passage.

8. A method of supplying fuels to a fuel injector with a coaxial quill assembly that includes a block; a quill at least partially positioned in the block and defining a first fuel passage extending between a first fuel inlet and a first fuel outlet, and a second passage extending between a second fuel inlet and a second fuel outlet; an outer tube with one end extending into the block, and being fluidly connected the second fuel outlet of the quill; an inner tube positioned in the outer tube, and being fluidly connected the first fuel outlet of the quill; a first compression load adjuster attached to the block and operably coupled to adjust a compression load on the inner tube; and a second compression load adjuster attached to the block and operably coupled to adjust a compression load on the outer tube; the method comprising the steps of:

moving a first fuel at a first pressure from a first common rail through the first fuel passage, through the inner tube and into a fuel injector;

moving a second fuel at a second pressure from a second common rail through the second fuel passage, through a space between the outer tube and the inner tube and into the fuel injector;

inhibiting leakage of the second fuel into the first fuel includes setting the first pressure higher than the second pressure;

inhibiting leakage of the first fuel into the second fuel includes setting a compression load on the inner tube above a first predetermined threshold with the first compression load adjuster; and inhibiting leakage of the second fuel to atmosphere includes setting a compression load on the outer tube above a second predetermined threshold with the second compression load adjuster.

9. The method of claim 8 including a step of venting leaked second fuel to atmosphere through a vent opening in the block.

10. The method of claim 9 wherein the first fuel is distillate diesel, and the second fuel is liquefied natural gas.

11. The method of claim 9 wherein the step of setting a compression load on the inner tube includes compressing the inner tube between conical seats of the quill and of the fuel injector.

12. The method of claim 11 wherein the step of inhibiting leakage of the second fuel to atmosphere includes sealing a space between the outer tube and the quill with an O-ring.

13. A dual fuel common rail fuel system comprising:

a quill defining a first fuel passage extending between a first fuel inlet and a first fuel outlet, and a second passage extending between a second fuel inlet and a second fuel outlet;

a fuel injector defining an outer conical seat concentrically surrounding an inner conical seat, and including an inner fuel inlet surrounded by the inner conical seat, and an outer fuel inlet positioned between the inner conical seat and the outer conical seat;

an outer tube compressed between the quill and the fuel injector and fluidly connecting the second fuel outlet of the quill to the second fuel inlet of the fuel injector;

an inner tube positioned in the outer tube and being compressed between the quill and the fuel injector, and fluidly connecting the first fuel outlet of the quill to the first fuel inlet of the fuel injector;

a first compression load adjuster operably coupled to adjust a load of the inner tube on the first conical seat; and a second compression load adjuster operably coupled to adjust a load of the outer tube on the second conical seat.

14. The dual fuel common rail fuel system of claim 13 wherein the outer tube includes a load shoulder in contact with the second compression load adjuster; and the first compression load adjuster being in contact with the quill.

15. The dual fuel common rail fuel system of claim 14 wherein the outer tube, the inner tube, the first compression load adjuster and the second compression load adjuster all share a common centerline.

16. The dual fuel common rail fuel system of claim 15 wherein the block includes a cover attached to a base; and one of the base and the cover define a vent opening extending between an interior cavity of the block and an outer surface of the block.

17. The dual fuel common rail fuel system of claim 16 wherein the second compression load adjuster includes a tool engagement surface located inside the block; and the first compression load adjuster includes a tool engagement surface located outside the block.

18. The dual fuel common rail fuel system of claim 17 wherein the inner tube is in contact with a conical seat of the quill; and an O-ring in sealing contact with the outer tube and the quill.

19. The dual fuel common rail fuel system of claim 18 wherein the first fuel inlet and the second fuel inlet of the quill are located outside the block;

a first O-ring in contact with the quill and the block and surrounding the first fuel passage; and a second O-ring in contact with the quill and the block and surrounding the second fuel passage.

20. The dual fuel common rail fuel system of claim 18 wherein the first common rail contains distillate diesel; and the second common rail contains liquefied natural gas.

* * * * *

UNITED STATES PATENT AND TRADEMARK OFFICE

CERTIFICATE OF CORRECTION

PATENT NO. : 8,522,752 B2
APPLICATION NO. : 12/875384
DATED : September 3, 2013
INVENTOR(S) : Kim et al.

It is certified that error appears in the above-identified patent and that said Letters Patent is hereby corrected as shown below:

In the Specification

Column 4, line 26, delete "Industrial Applicability" and insert -- INDUSTRIAL APPLICABILITY --.

Signed and Sealed this
Eleventh Day of August, 2015

Michelle K. Lee

Michelle K. Lee
*Director of the United States Patent and Trademark Office*